United States Patent [19]

Raasch

[11] Patent Number: 4,998,406

[45] Date of Patent: Mar. 12, 1991

[54] SILVER CAN TRANSPORT CARRIAGE

[75] Inventor: Hans Raasch, Monchen-Gladbach, Fed. Rep. of Germany

[73] Assignee: W. Schlafhorst & Co., Fed. Rep. of Germany

[21] Appl. No.: 400,690

[22] Filed: Aug. 30, 1989

[30] Foreign Application Priority Data

Sep. 17, 1988 [DE] Fed. Rep. of Germany ..... 3831638

[51] Int. Cl.[5] ..... D01H 9/10; D01H 5/28; D04H 11/00

[52] U.S. Cl. ..... 57/281; 57/276; 19/159 A

[58] Field of Search ..... 57/90, 276, 277, 281; 19/159 R, 159 A

[56] References Cited

U.S. PATENT DOCUMENTS 4,150,534 4/1979 Raasch ..... 57/281

FOREIGN PATENT DOCUMENTS 0220200 3/1986 European Pat. Off. .
1292049 11/1969 Fed. Rep. of Germany .
2352649 5/1974 Fed. Rep. of Germany .
2518224 11/1976 Fed. Rep. of Germany .
2536479 2/1977 Fed. Rep. of Germany .
2554915 6/1977 Fed. Rep. of Germany .
3440598 5/1986 Fed. Rep. of Germany .
3505496 8/1986 Fed. Rep. of Germany .
3524922 1/1987 Fed. Rep. of Germany .
3532172 3/1987 Fed. Rep. of Germany .
3621370 3/1987 Fed. Rep. of Germany .
3614654 11/1987 Fed. Rep. of Germany .
3627062 1/1988 Fed. Rep. of Germany .
623614 12/1978 Switzerland .
614430 12/1948 United Kingdom .

OTHER PUBLICATIONS

"Garnfehleruberwachung", *Textilpraxis International*, Sep. 1977.

*Primary Examiner*—Daniel P. Stodola
*Assistant Examiner*—John P. Darling
*Attorney, Agent, or Firm*—Shefte, Pinckney & Sawyer

[57] ABSTRACT

A can transport carriage for supplying an automatic spinning machine with full cans of sliver includes a rotating turntable having multiple can parking positions at equal radial spacings from the turntable axis and a can manipulating arrangement movable between a can transfer position immediately above one of the parking positions and a can delivery position at the spinning machine for moving a full sliver can from the one parking position to the spinning machine. An indexing drive rotatably indexes the turntable by one parking position for individually positioning each parking position in sequence at the can transfer position of the manipulating arrangement.

4 Claims, 1 Drawing Sheet

SILVER CAN TRANSPORT CARRIAGE

BACKGROUND OF THE INVENTION

The present invention relates to apparatus for supplying an automatic spinning machine with full cans of sliver and, more particularly, to a sliver can transport carriage having a can manipulating arrangement for transferring full and empty sliver cans to and from a spinning machine.

In their simplest form, sliver can transport carriages are adapted to carry a single sliver can. Such a can transport carriage may provide a permanent parking position for an empty can, located beneath a can loading position. In such can transport carriages, it is necessary to first remove the empty can before the carriage can readily deliver a full sliver can to the spinning machine. Accordingly, a further operation of the carriage is necessary to deliver the empty can to a removal position and then to receive a full sliver can at another position before the carriage is enabled to deliver a full can to the spinning machine.

Other can transport carriages incorporate considerably more complicated mechanisms for transporting several sliver cans at once and for supplying the spinning positions of a spinning machine with full sliver cans while also at the same time removing empty sliver cans from the spinning positions. In general operation, the empty sliver can at a spinning position much first be removed and deposited on a storage position on the can transport carriage. The can manipulating mechanism required to accomplish this operation must be capable of changing its relative position to the can transport carriage to also subsequently receive a full sliver can at a parking position and then deliver the full can to the spinning position of the spinning machine. The other full sliver cans carried by the transport carriage are supported at other parking positions from which the can manipulating arrangement must be capable of grasping and delivering the full cans in succession to other spinning positions of the spinning machine.

SUMMARY OF THE INVENTION

It is accordingly an object of the present invention to provide a can transporting carriage for supplying an automatic spinning machine with full cans of sliver of a simplified yet operationally safe and effective construction.

Briefly summarized, the can transporting carriage of the present invention has a rotating table defining a plurality of can parking positions at equal radial spacings from the rotational axis of the table for supporting full cans of sliver at the parking positions. A can manipulating arrangement is provided with a can transfer position associated with one of the parking positions for moving a can of sliver from the one parking position to the automatic spinning machine. The can manipulating arrangement includes a mechanism for rotatably indexing the table by one parking position for individually positioning each parking position in sequence at the can transfer position of the can manipulating arrangement.

In the preferred embodiment, the can transport carriage may be additionally adapted for removal of empty sliver cans from the associated spinning machine by the can manipulating arrangement. In such embodiment, at least one of the can parking positions on the rotating table of the transporting carriage is not provided with a full sliver can in order to provide an open parking position at which may be placed the initial empty sliver can removed from the spinning machine by the can manipulating arrangement. The remaining parking positions of the rotating table of the carriage are occupied by full sliver cans for operation in the normal manner. Thus, in operation, the can manipulating arrangement initially transfers an empty sliver can from a spinning position of the spinning machine to the open parking position of the rotating table of the can transporting carriage. The rotating table is then indexed by one parking position to bring a full sliver can into disposition for transfer by the can manipulation arrangement to the spinning position of the spinning machine from which the empty can was removed. The parking position previously occupied by such full sliver can is thereby opened so that the operational sequence can be repeated at another spinning position of the spinning machine whereat a sliver can has been emptied.

The can transfer position of the can manipulating arrangement is preferably disposed above the one can parking position of the rotating table at substantially the same radial spacing from the rotational axis of the table as the one can parking position.

It is also preferred that the rotating table include a rotatable can support plate at each parking position and that the can manipulating arrangement include a driving arrangement for rotating the support plate of the particular parking position located at the can transfer position. A controller for the driving arrangement includes a sensor for detecting a terminal end of sliver in a full can on the support plate of the parking position at the can transfer position.

Such an arrangement advantageously enables each full sliver can to be presented to a spinning position of the spinning machine with the leading end of sliver in the can at a predetermined location to enable the spinning machine to take up the sliver in a simple manner. Otherwise, a danger exists that the spinning position of the spinning machine may be unable to locate the leading end of sliver when a full can is delivered thereto, rendering the entire can replacement procedure ineffective.

In the preferred embodiment, the driving arrangement for the can support plates utilizes a drive wheel for frictionally driving the can support plate of the parking position located at the can transfer position of the can manipulating arrangement. The drive wheel may be arranged to engage the body of the can or a lower edge thereof or, alternatively, the can support plate. The sensor of the drive controlling arrangement for the can support plates insures that each full sliver can is positioned with the leading end of the sliver therein in a uniform predetermined disposition relative to the can manipulating arrangement or otherwise is oriented in a predetermined direction before each can replacement procedure is initiated by the can manipulating arrangement. It is not necessary that the orientation of the sliver end correspond with the direction in which the sliver end faces after delivery to the spinning machine by the can manipulating arrangement, which may be changed by the particular transfer motions carried out by the can manipulating arrangement, e.g. pivoting movements or otherwise. So long as the sliver end of each full can has substantially the same disposition before each can transfer operation, any movements carried out by the can manipulating arrangement should involve a substantially uniform degree of angular change in the orientation of the sliver cans during each can transfer operation so that the sliver ends of all cans delivered to the spinning machine should still have a substantially uniform disposition when presented to the spinning machine.

DESCRIPTION OF THE PREFERRED EMBODIMENT

Figure 1:
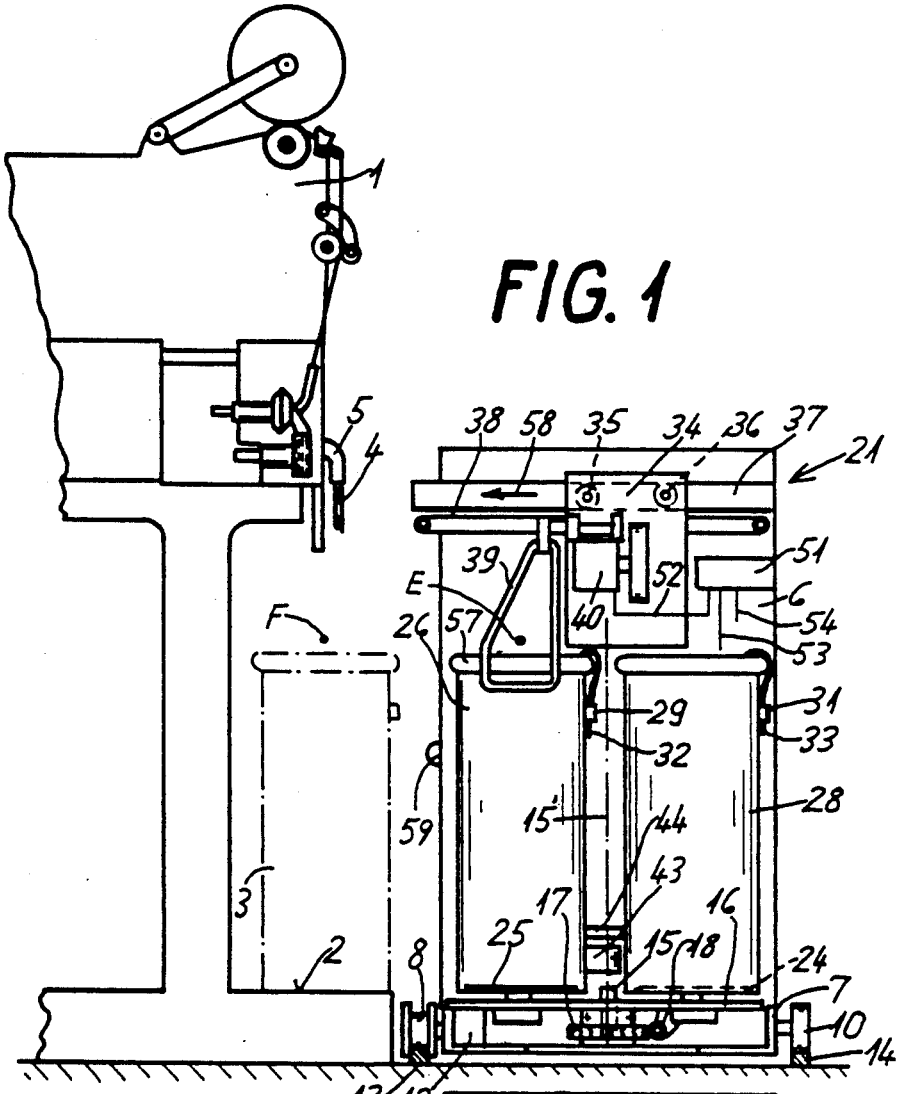
FIG. 1 is a side elevational view of a can transport carriage according to the preferred embodiment of the present invention, shown in a parked disposition at a spinning position of a spinning machine.

Referring now to the accompanying drawings and initially to FIG. 1, a can transporting carriage according to the preferred embodiment of the present invention is indicated at 6 in a parked position at the forward or front side of a spinning position 1 of an automatic spinning machine such as a conventional open end rotor spinning machine of a known construction and operation. As is known, such spinning machines have a plurality of the spinning positions 1 arranged side-by-side along the lengthwise extent of the machine. The spinning machine includes a support position 2 at each spinning position 1 whereat a sliver can is supported during normal machine operation for feeding sliver to the spinning position 1, the normal disposition of a can being indicated at 3 in broken lines to represent that the can 3 has already been removed after becoming empty. Thus, the trailing end of the sliver previously fed to the spinning position 1 from the removed sliver can 3 is indicated at 4 to extend outwardly from an inlet connection 5 to the spinning position 1.

The can transporting carriage 6 of the present invention includes an undercarriage frame 7, one side of which rotatable supports a pair of longitudinally spaced flanged wheels 8, 9 and the other side of which similarly supports rotatably a pair of smooth-surfaced wheels 10, 11. The can transport carriage 6 is rollably supported by its wheels 8, 9, 10, 11 on a pair of floor-supported guide rails 13, 14 extending in parallel spaced relation along the length of the spinning machine. A drive motor 12 is connected to the flanged roller 8 for driving the carriage back-and-forth along the rails 13, 14.

A turntable 16 is rotatably supported by a central axial shaft 15 on the undercarriage 7. The turntable 16 includes four parking positions A, B, C and D at equal circumferential and radial spacings with respect to the axial shaft 15 for disposition of a sliver can at each parking position as hereinafter more fully explained.

A worm gear 17 is fixedly attached to the axial shaft 15 of the turntable 16 and meshes with a drive screw 18 mounted at the end of a drive shaft 19 of an indexing motor 20.

A can support plate 22, 23, 24, 25 is rotatably supported by the turntable 16 at each of its parking positions A, B, C, D. In the drawings, sliver cans 26, 27, 28, respectively, are shown as being supported on the rotatable plates 22, 23, 24, with only rotatable plate 25 being unoccupied so as to be directly visible in the drawings. Each sliver can includes a clamp on its outer periphery adjacent its upper end for holding the leading end of sliver stored within the can, the clamps of sliver cans 26, 27, 28 being respectively indicated at 29, 30, 31 with the leading sliver ends of cans 26 and 28 being designated by 32 and 33, respectively.

A can transfer apparatus, generally indicated at 21, is mounted at one longitudinal end of the transport carriage 6 for transferring the full sliver cans 26, 27, 28 to respective spinning positions 1 of the associated spinning machine. The can transfer apparatus 21 includes a can manipulating assembly 34 mounted along a horizontal rail 37 for movement toward and away from the spinning positions 1 of the spinning machine. The manipulating assembly 34 includes a pair of can grasping arms 39 laterally movable toward and away from one another into and out of can grasping relationship as well as vertically movable toward and away from the turntable 16. The grasping arms 39 are movable with the manipulating assembly 34 between a can transfer position E disposed immediately above the parking position A of the turntable 16 at substantially the same radial spacing as the parking position A from the rotational axis 15 and a can delivery position F disposed immediately above the can support position 2 of the spinning station 1. As shown in FIG. 1, the manipulating assembly 34 is disposed in its can transfer position E. Movement of the manipulating assembly 34 along the rail 37 between the can transfer and delivery positions E, F is actuated by an endless drive belt 38 driven by a motor 40.

The can replacement apparatus 21 further includes a can rotating mechanism 41 for actuating rotation of the particular sliver can disposed at any given time in the parking position A immediately beneath the transfer position E, as represented by the can 26 in the drawings. The rotating mechanism 41 is controlled by a sensor 42 arranged to detect the leading end of sliver in the can at the parking position A, e.g. the sliver end 32 held by clamp 29 of the sliver can 26, as the can is rotated by the mechanism 41. The rotating mechanism 41 includes a frictional drive wheel 43 rotatably mounted on a lever arm 44 horizontally pivotable to the undercarriage 7 at 55 for movement of the wheel 43 into and out of frictional peripheral engagement with the can at the parking position A.

Preferably, the sensor 42 is an optoelectric sensor arranged to direct its optical sensing line 46 at a location on the periphery of a sliver can in the parking position A whereat it is predetermined the leading end of sliver held by the clamp of the can, e.g., sliver end 23 held in clamp 29, should be relatively positioned by rotation of the can in advance of transferring the sliver can from the parking position A to the spinning position 1 of the spinning machine. The sensor 42 is operatively connected via a control line 47 with an electromagnetic drive 48 having an extensible rod 49 connected in driving engagement with the lever arm 44 to control movement of the frictional drive wheel 43 into and out of driving engagement with the particular sliver can at the parking position A.

The turntable 16 is rotatable about its axis 15 in the direction of arrow 50 in an indexing fashion by one parking position by actuation and deactuation of the drive motor 20 according to a predetermined operational program. For this purpose, the transport carriage 6 is provided with a conventional program controller 51 operatively connected by a control line 52 to the drive motor 40 of the can manipulating assembly 34, by a control line 53 to the motor 20 of the turntable 16, and by a control line 64 to the motor 12 associated with the flanged wheel 8 of the undercarriage 7.

Figure 2:
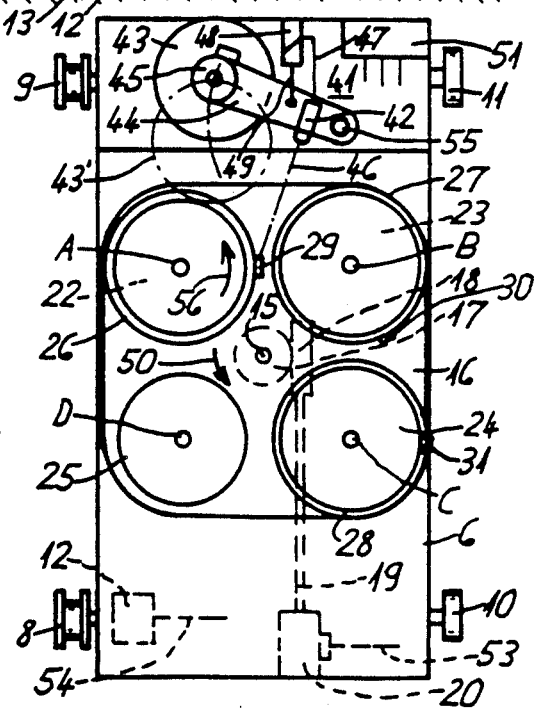
FIG. 2 is a top plan view of the can transport carriage of FIG. 1.

The operation of the transport carriage 6 for transferring a full sliver can, e.g. can 26, to the spinning position 1 of the spinning machine may thus be understood. Once a sliver can in operation at a support position 2 of the spinning machine is exhausted of sliver, the empty sliver can is removed either manually or by some other means, as represented by the broken line indication of can 3 in FIG. 1. The transport carriage 6 is driven by the motor 12 lengthwise along the spinning machine until a sensor 59 mounted on the carriage 6 in operative association with the program controller 51 recognizes the absence of the emptied can at the spinning position, e.g. can 3 at spinning position 1, whereupon the program controller 51 deactuates the carriage drive motor 12 via the control line 54, thereby stopping the can transport carriage 6 in a parked disposition at the spinning position 1, all as represented in FIGS. 1 and 2.

Prior to the can transport carriage 6 reaching the spinning position 1, the motor 20, also under the control of the program controller 51, is operated to rotationally index the turntable 16 in the direction of the arrow 50 by one parking position to bring a full sliver can, e.g., can 26, to the parking position A vertically beneath the can transfer position E of the can grasping arms 39 on the manipulating assembly 34. Also during the travel of the can transport carriage 6 prior to reaching the spinning position 1, the sensor 42 determines whether the sliver end 32 held by the clamp 29 of the sliver can 26 indexed to the parking position A is located in the optical sensing line 46 of the sensor 42 and, if not, the sensor 42 actuates the electromagnetic drive 48 via the control line 47 to pivot the lever 44 to bring the frictional drive wheel 43 into driving engagement with the lower end of the can 26 at the parking position A, this disposition of the drive wheel 43 being indicated in broken lines in FIG. 2 at 43'. The frictional drive wheel 43 is driven at a relatively slow peripheral speed to slowly rotate the sliver can 26, and at the same time the rotating plate 22 on which the can 26 is mounted, in the rotational direction of the arrow 56 until the leading sliver end 32 held in the clamp 29 of the can 26 is brought into the optical sensing line 46 of the sensor 42. At that instant, the sensor 42 deactuates the electromagnetic drive 48 to withdraw the frictional drive roller 43 out of driving contact with the can 26. This condition of the can driving arrangement 41 is represented in full lines in FIG. 2.

As soon as the transport carriage 6 is parked at the spinning position 1 for purposes of performing a can replacement operation, the program controller 51 actuates the grasping arms 39 of the manipulating assembly 34 to pivot inwardly with respect to one another, thereby grasping the upper beaded end 57 of the can 26 at the parking position A of the turntable 16. Thereupon, the drive motor 40 of the manipulating assembly 34 is actuated by the program controller 51 to slightly raise the can 26 and then to move the manipulating assembly 34 along the guide rail 37 in the direction of the arrow 58 toward the spinning position 1.

Once the can grasping arms 39 of the manipulating assembly 34 are situated immediately above the can delivery position F, the program controller 51 operates the drive motor 40 to slightly lower the can 26 onto the support position 2 of the spinning machine and then to pivot the grasping arms 39 outwardly with respect to one another to release the can 26, at which point the can 26 is disposed in the same position previously occupied by the emptied can 3. During this described operation of the manipulating assembly 34, the program controller 51 at the same time actuates the motor 20 to indexably rotate the turntable 16 in the direction of the arrow 50 by another parking position to bring the parking position B with the can 27 into the disposition previously occupied by the parking position A.

Thereupon, the sensor 42 actuates the can rotating arrangement 41, as necessary, to rotationally position the can 27 to locate its clamped leading end of sliver in the line of optical sensing of the sensor 42.

After the can grasping arms 39 have been opened to release the can delivered to the spinning position 1, the manipulating assembly 34 is operated by the motor 40 under the control of the program controller 51 to return to the initial can transfer position E shown in FIG. 1. Thereupon, the program controller 51 reenergizes the carriage drive motor 12 to cause the transport carriage 6 to resume travel along the spinning machine.

The can transport carriage 6 is also capable of removing an emptied can from a spinning position of the spinning machine prior to transferring a full can to the spinning position. To accomplish operation in this manner, only the controlling program stored in the program controller 51 need be changed. The other mechanisms and arrangements of the can transport carriage 6 are unchanged. For operation in this mode, the controller 51 is programmed to initially locate an unoccupied parking position of the turntable 16, e.g. the parking position D, beneath the can transfer position E of the manipulating assembly 34. Once the can transport carriage 6 is parked at a non-operating spinning position 1 whereat the sliver can has been emptied, the program controller 51 actuates the manipulating assembly 34 to initially advance along the guide rail 37 to locate the grasping arms 39 at the can delivery position F over the empty can 3 and then to pivot the grasping arms 39 toward one another and raise the arms 39 to grasp the empty can. The manipulating assembly 34 is then returned to the can transfer position E whereat the grasping arms 39 are lowered and pivoted outwardly to release the empty can 3 onto the unoccupied parking position D of the turntable 16. The controller 51 then actuates the indexing motor 20 to rotationally index the turntable 16 to bring the next succeeding parking position, e.g. parking position A, into disposition immediately beneath the can transfer position E of the manipulating assembly 34, whereupon the can transfer operation is carried out in the same manner as described above. After completion of the can transfer operation, the turntable 16 would not be indexed in advance of travel to and parking at another spinning position requiring replacement of its sliver can, thereby to insure that the parking position of the turntable 16 immediately beneath the can transfer position E of the manipulating assembly 34 at the start of a can transfer operation is always unoccupied. Additionally, the sensor 42 in such embodiment must be arranged to recognize the leading sliver end of a sliver can as opposed to the retaining clamp, in order to distinguish a full sliver can from an empty can.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for supplying plural spinning stations of an automatic spinning machine with full cans of sliver, comprising a can transporting carriage, movable to travel along the automatic spinning machine between its spinning stations, said carriage having a rotating table defining a plurality of can parking positions at equal radial spacings from the rotational axis of the table for supporting full cans of sliver at the parking positions, and can manipulating means having a can transfer position associated with one of the parking positions for moving a can of sliver from the one parking position to the automatic spinning machine, the can manipulating means including means for rotatably indexing the table by one parking position for individually positioning each parking position in sequence at the can transfer position of the can manipulating means.

2. Apparatus for supplying an automatic spinning machine with full cans of sliver according to claim 1 and characterized further in that the can transfer position of the can manipulating means is disposed above the one can parking position of the table at substantially the same radial spacing from the rotational axis of the table as the one can parking position.

3. Apparatus for supplying an automatic spinning machine with full cans of sliver according to claim 1 and characterized further in that the table includes a rotatable can support plate at each parking position and the can manipulating means includes means for rotatably driving the support plate of the parking position located at the can transfer position of the can manipulating means and means for controlling the plate driving means, the controlling means including a sensor for detecting a terminal end of sliver in a full can on the support plate of the parking position located at the can transfer position of the can manipulating means.

4. Apparatus for supplying an automatic spinning machine with full cans of sliver according to claim 3 and characterized further in that the plate driving means comprises a drive wheel for frictional driving of the can support plate of the parking position located at the can transfer position of the can manipulating means.

* * * * *